United States Patent [19]

Luzzi

[11] Patent Number: 4,955,823

[45] Date of Patent: Sep. 11, 1990

[54] 600-AMP HOT STICK-OPERABLE SCREW AND PIN-AND-SOCKET ASSEMBLED CONNECTOR SYSTEM

[75] Inventor: Glenn J. Luzzi, Mt. Bethel, Pa.

[73] Assignee: Amerace Corporation, Parsippany, N.J.

[21] Appl. No.: 419,514

[22] Filed: Oct. 10, 1989

[51] Int. Cl.[5] ..... H01R 31/08

[52] U.S. Cl. ..... 439/507; 439/784; 439/805; 439/921

[58] Field of Search ..... 439/88, 89, 181, 183–187, 439/359, 361, 362, 480, 507, 784, 801, 805, 921

[56] References Cited

U.S. PATENT DOCUMENTS

| | | | |
|---|---|---|---|
| 4,202,591 | 5/1980 | Borgstrom | 439/185 |
| 4,354,721 | 10/1982 | Luzzi | 439/921 |
| 4,758,175 | 7/1988 | Didier et al. | 439/805 X |
| 4,799,895 | 1/1989 | Borgstrom | 439/183 |
| 4,891,016 | 1/1990 | Luzzi et al. | 439/183 |

FOREIGN PATENT DOCUMENTS

| | | | |
|---|---|---|---|
| 1444767 | 8/1976 | United Kingdom | 439/921 |

*Primary Examiner*—Neil Abrams
*Assistant Examiner*—Khiem Nguyen
*Attorney, Agent, or Firm*—David Teschner

[57] ABSTRACT

A high voltage cable is fixed to the single leg of a 600-Amp "T" connector having a first of its cross bar arms mounted upon an insulating bushing fixed to a wall of the apparatus housing it is to serve. Spaced apart from such insulating bushing and mounted upon the same wall is an apparatus bushing to which is connected a bushing extender. An "h" shaped link member is employed to couple the cable via the other of its "T" connector cross bar arms to the apparatus bushing via the bushing extender. One of the short arms of the link member contains a pin/socket arrangement to make an electrical connection with the cable. The remaining short arm contains a screw-operated member operated by a tool inserted through the single long arm to make and break electrical and mechanical connections between the link member and the bushing extender. When removed, the link member not only interrupts the circuit but provides a visual indication thereof.

9 Claims, 6 Drawing Sheets

600-AMP HOT STICK-OPERABLE SCREW AND PIN-AND-SOCKET ASSEMBLED CONNECTOR SYSTEM

CROSS-REFERENCE TO RELATED APPLICATION

Application for U.S. Letters Patent Ser. No. 07/329,972 filed Mar. 29, 1989, now U.S. Pat. No. 4,891,016 entitled "600-Amp Hot Stick-Operable Pin-And-Socket Assembled Connector System" by Glenn J. Luzzi and James E. Cole, and assigned to the Assignee of the instant application.

BACKGROUND OF THE INVENTION

1. Field of the Invention

The invention is directed to the field of high voltage separable connector systems and more particularly to a 600-Amp stick-operable connector system used to interengage an electrical apparatus with a high voltage cable.

2. Description of the Prior Art

Proper maintenance procedures in high-voltage systems involving transformers or switches and cable systems require that the system be de-energized and isolated by opening the switches at both ends of the cable run. The cable system is then tested to ascertain that it is actually de-energized and then each phase is grounded at both ends to prevent injury should the cable system become accidentally energized. Finally, the cables are removed from the switch or transformer bushings to achieve a visible break between the cables and their respective bushings.

A far simpler method for connecting and disconnecting transformers and switches with cable systems which did not require the physical movement of the 600-Amp cable to a parking station remote from its usual position and which still gave the required visual break and which facilitated the testing and grounding of each phase was shown, described and claimed in U.S. Pat. No. 4,799,895, issued Jan. 24, 1989, entitled 600-Amp Hot Stick-Operable Screw-Assembled Connector System by Alan D. Borgstrom and assigned to the Assignee of the instant invention and by this reference incorporated herein as if the same were reproduced herein. The device of that patent uses a contact extender in each of its "T" shaped cable connectors and in the assembly of the bushing extender to the apparatus bushing into which the threaded studs of the link member are screwed to assemble the link member with the cable connector and bushing extender. Despite great care in the design to insure that all components are aligned before the link member bolts are extended and threadably engaged with the contact extenders, some users fear that the link member bolts and contact extenders can be cross threaded thereby preventing proper coupling and uncoupling of the link member with the cable and apparatus bushing.

An alternative construction to that of the above-cited patent, which preserves all of its highly desirable qualities while substituting a pin-and-socket coupling arrangement for the screw-operated features of the patent is shown, described and claimed in the above-identified patent application Ser. No. 07/329,972 filed Mar. 29, 1989, and by this reference incorporated herein as if the same were reproduced herein. An external, link-operating assembly is provided to insure proper assembly and disassembly of the link member from the cable connector and apparatus bushing assembly. In addition, the link-operating assembly holds the link member, the cable connector and apparatus bushing assembly together which removes any requirement that the pin-and-socket components assemble or hold in assembly these elements.

The drawback of this alternative system is the requirement of the external, link-operating assembly which is large, bulky, expensive and requires a great deal of space for operation.

SUMMARY OF THE INVENTION

The present invention overcomes the difficulties noted above with respect to prior art 600-Amp stick-operable connector systems by providing an easily movable link member screw-operable to selectively engage either a fixed 600-Amp high voltage cable, with connector attached, or the bushing of an electrical apparatus and a pin-and-socket combination to electrically couple the other.

The link member is made up of one 600 Ampere to 200 Ampere loadbreak reducing tap plug and one 600 Ampere plug interface joined by an internal buss bar suitably insulated. In the bore of the loadbreak reducing tap is placed a bolt with an enlarged head and a socket which can be controlled by a suitable tool inserted into the socket through the loadbreak mechanism. The bolt is retained in the bore and is limited in its travel so that when it is advanced it bears against an annular shoulder of the bore and causes the link member to be mechanically and electrically joined with either of the cable or bushing. When the bolt is withdrawn, it bears against an annular retaining ring in the bore and separates the link member.

The pin-and-socket combination are mated and separated as the bolt is advanced or withdrawn and provides electrical connection only. It is an object of this invention to provide a novel screw-operated interconnect system between a high voltage cable and an electrical apparatus.

It is an object of this invention to provide a novel screw-operated interconnect system between a high voltage cable and an electrical apparatus using both a pin-and-socket and screw-operated member to establish electrical continuity.

It is another object of this invention to provide a novel interconnect system between a high voltage cable and an electrical apparatus where a screw-operated member mechanicaly interconnects the interconnect system and electrically interconnects or disconnects itself and a separate pin-and-socket connector.

It is still another object of this invention to provide a novel interconnect system between a high voltage cable and an electrical apparatus using a movable bolt restrained within the interconnect system.

Other objects and features of the invention will be pointed out in the following description and claims and illustrated in the accompanying drawings which disclose, by way of example, the principles of the invention and the best mode which has been contemplated for carrying it out.

BRIEF DESCRIPTION OF THE DRAWING

In the drawings in which similar elements are given similar reference characters.

DESCRIPTION OF THE PREFERRED EMBODIMENT

Figure 1:
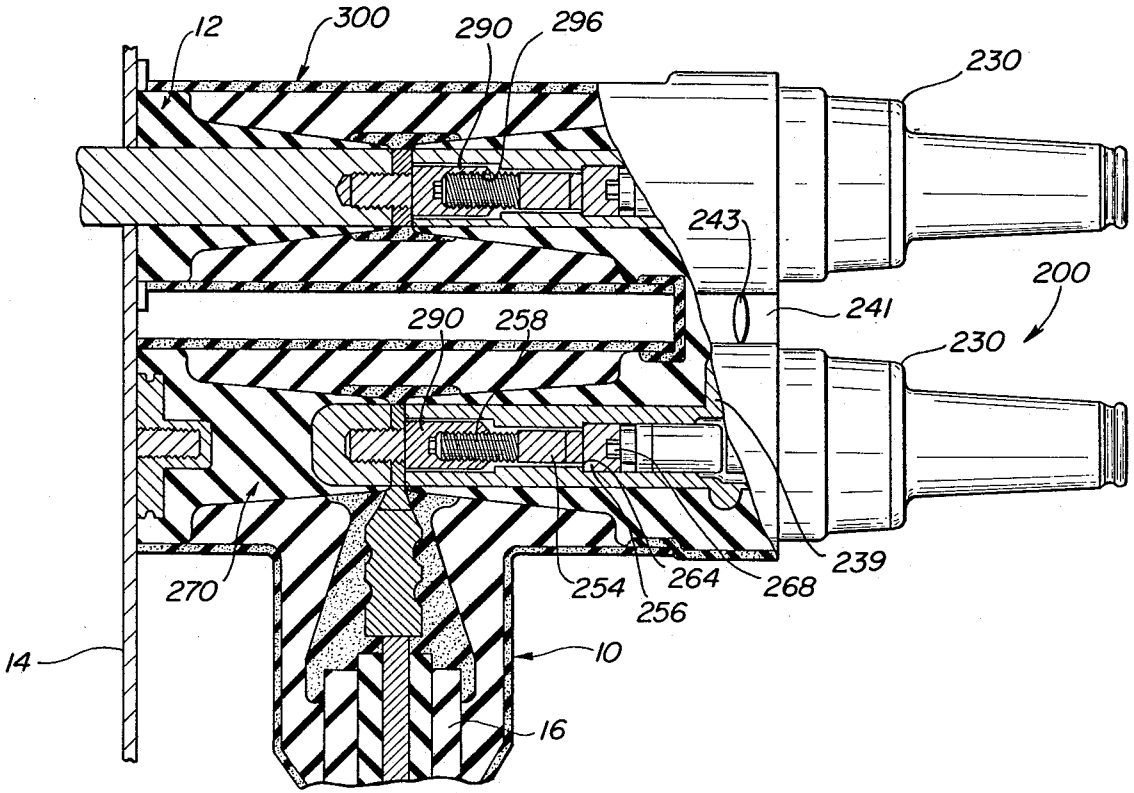
FIG-1 PRIOR ART
FIG. 1 is a fragmentary, side elevation, partially in section, showing a completed interconnect between a high voltage cable connected to a "T" shaped connector and an apparatus bushing employing a bushing extender, contact extenders and link assembly according to prior art practices and is FIG. 10 of U.S. Pat. No. 4,799,895 issued Jan. 24, 1989 with the addition of some reference characters shown in the drawings of that patent.

Turning to FIG. 1, there is shown a fully screw-operated link member 200 according to the above-identified patent. Each assembly 230 has a bolt 254 positioned in a bore with a threaded end portion 258 and a head portion 256 containing a socket 268 which can accept a tool inserted through the open end of assembly 230. A shoulder 264 is engaged by leading surface of head portion 256 to pull link member 200 into place as threads 258 engage internally-threaded recess 296 of contact extender 290. No rear restraint for the bolts 254 are placed in the bores of the assemblies 230 since the bolts 254 must be free to move clear of the contact extenders 290 so that there is no premature engagement between threads 258 of the bolts and 296 of contact extender 290 which could cause them to jam or cross thread while one of the bolts 254 is being torqued up. The absence of any rear shoulder or rear restraint for the bolt 254 makes removal of link 200 more difficult since both interfaces must be removed simultaneously.

Figure 2:
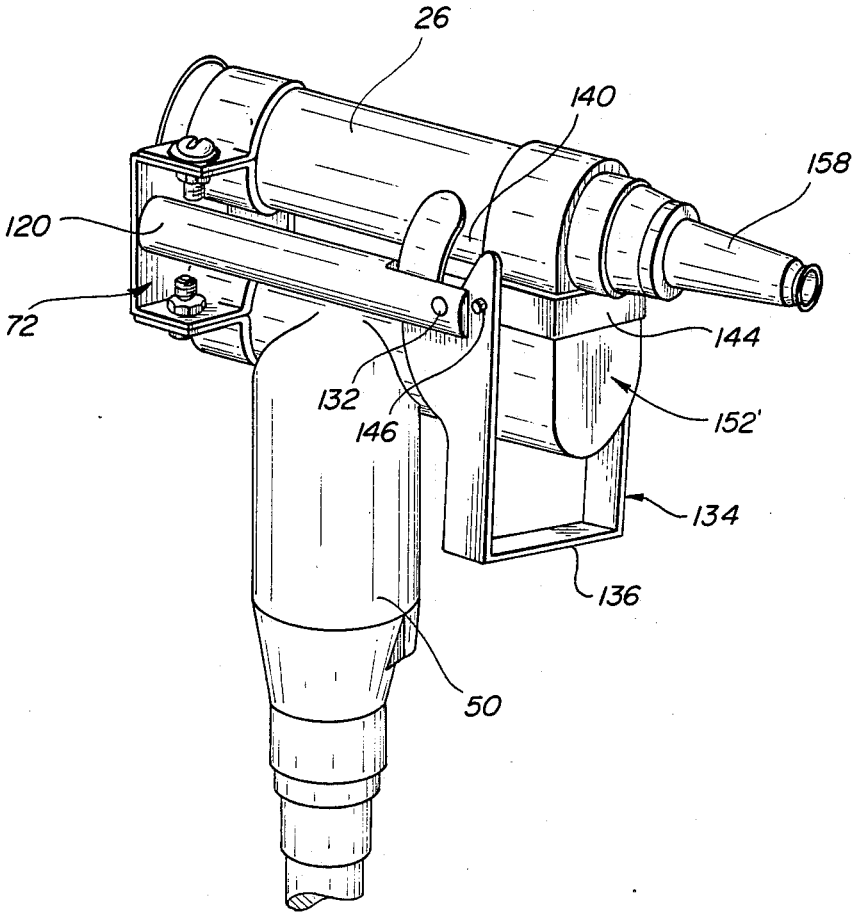
FIG-2 PRIOR ART
FIG. 2 is a front perspective view of a completed interconnect between a high voltage cable connected to a "T" shaped connector, an apparatus bushing extender, support bracket and operating link assembly according to prior art practices and is FIG. 2 of the above-identified application.
Figure 3:
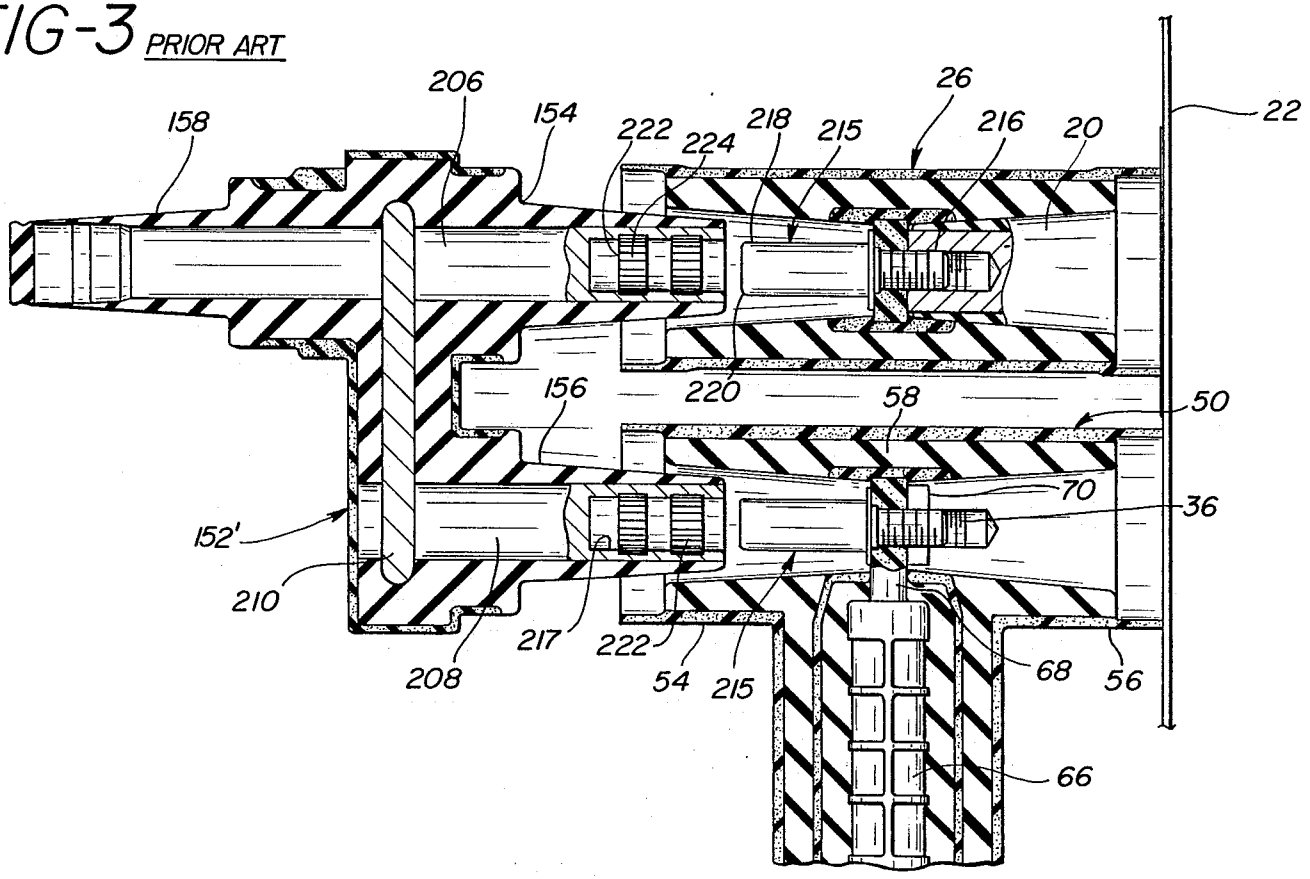
FIG-3 PRIOR ART
FIG. 3 is a fragmentary side elevational view, partially in section, of an apparatus bushing, apparatus bushing extender, high voltage cable connected to a "T" shaped connector and interconnecting link, prior to final assembly, with the operating link assembly omitted and is FIG. 7 of the above-identified application.
Figure 4:
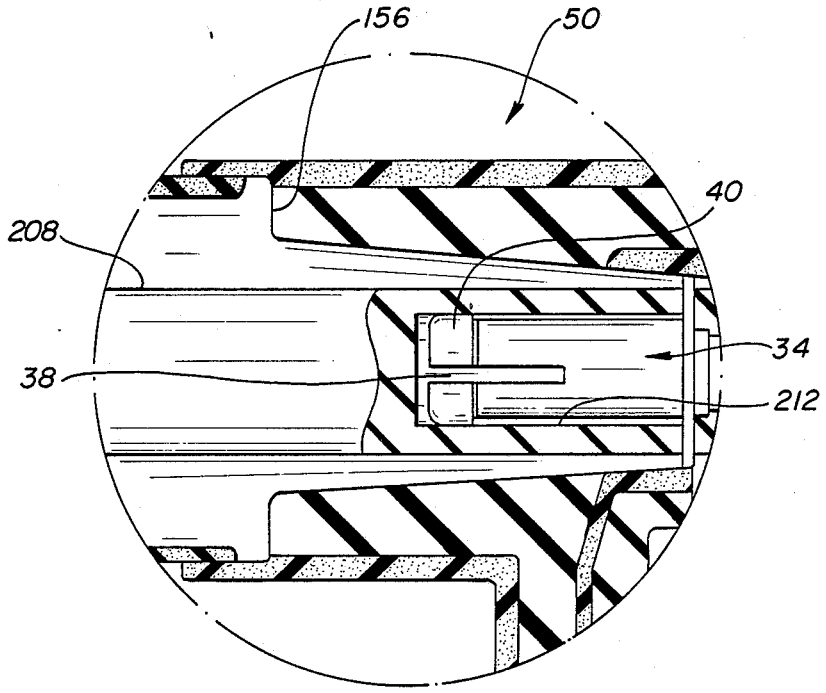
FIG-4 PRIOR ART
FIG. 4 is a fragmentary side elevation, partly in section, of a fully-engaged alternate pin-and-socket arrangement and is FIG. 6 of the above-identified application.

One approach to eliminating the potential problems of jamming or cross threading of the bolts 254 while employing the advantages of link member 200 is shown in FIGS. 2, 3 and 4 as more fully described in the above-identified application. Instead of the internally-threaded contact extenders 290, a plug 215 with a cylindrical contact portion 218 is employed. The externally threaded portion 216 serves to unite the parts in the same manner as the contact extenders 290. Link member 152' has in each of its legs 154 and 156 a socket 217 with one or more louvered rings 222 to make electrical contact between the walls of socket 217 and contact portion 218 of plug 215 as is illustrated in FIG. 3.

An alternative pin-and-socket arrangement is shown in FIG. 4 where plug 34 has a segmented bulbous end 40 for receipt within the smooth-walled sockets 212 of arms 154 and 156 of link member 152.

Assembly of the link member 152' to the bushing extender 26 and the "T" shaped connector 50 is shown in FIG. 2 and is accomplished by link operating system 134. A pushing arm 144 advances link 152' as operating handle 136 is rotated toward "T" shaped connector 50 about pivot pins 146 advancing the slot 140 along roller sleeve 130 mounted on pin 132 on member 120. The link 152' is separated by the opposite movememt of operating handle 136. In the position shown in FIG. 2, the arms 154 and 156 are fully seated as are the various pin-and-socket combinations and the link 152' is firmly held in position. When the operating handle 136 is moved to the fully horizontal position, the arms 154 and 156 are withdrawn and the pin-and-socket connections are broken and the link 152' can be fully removed.

As above mentioned, the link operating system 134 is large and bulky requiring not only the system 134 but also the bracket 72 and the members 120. It also requires a great deal of space and large open-front space so that the operating handle 136 can be rotated. It does offer a small reduction in the size of the link 152' since only one arm 158 is required. A single arm 158 with loadbreak facility is sufficient to test the high voltage cable and the bushing and there is no need for access to the second end of the link 152'.

Figure 5:
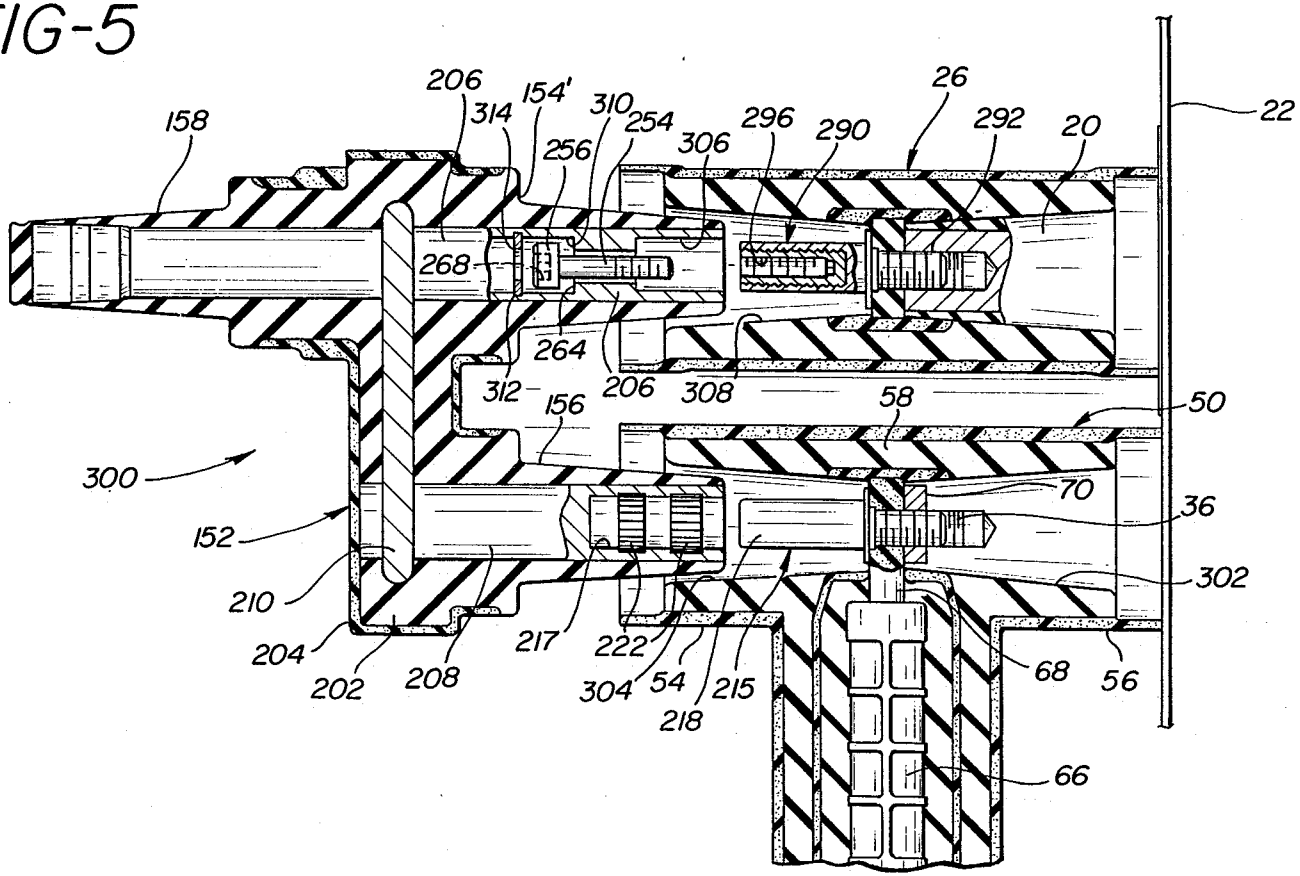
FIG. 5 is a fragmentary side elevational view, partially in section, of an apparatus bushing, apparatus bushing extender, high voltage cable connected to a "T" shaped connector and an interconnecting link member constructed in accordance with the concepts of the invention just prior to assembly.
Figure 6:
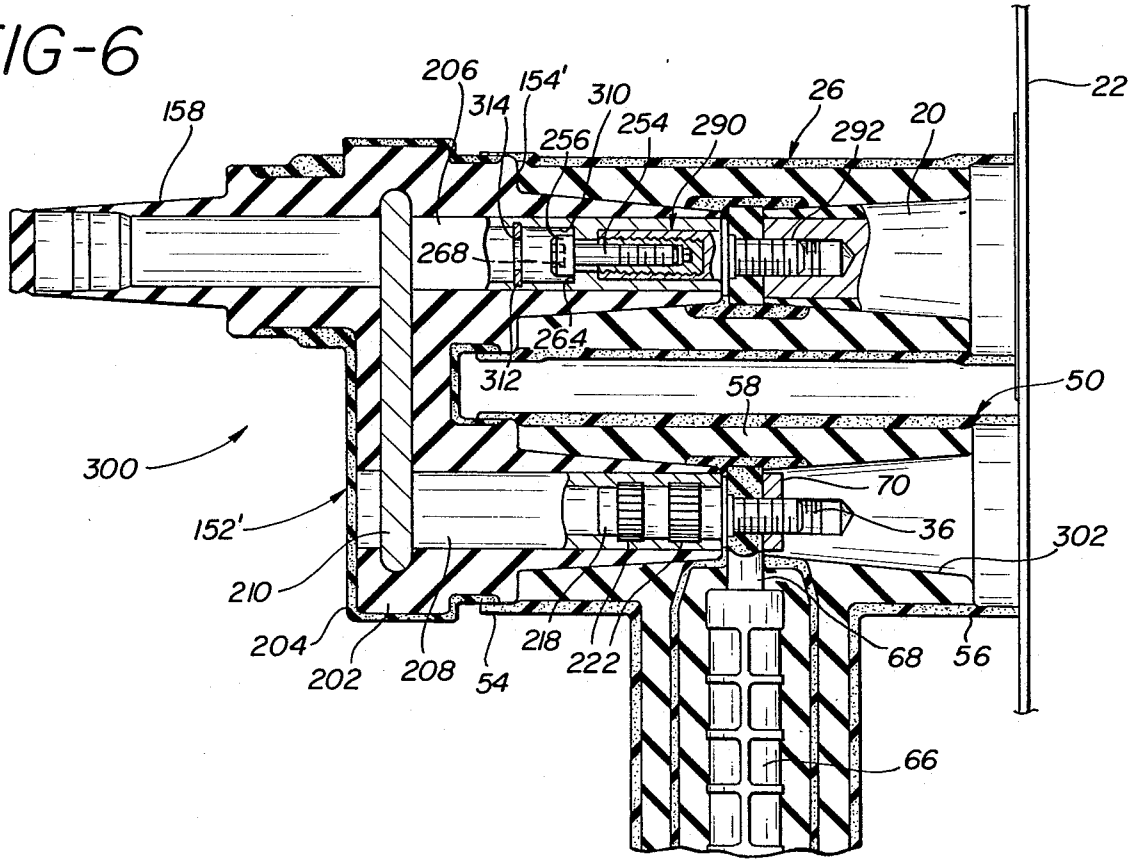
FIG. 6 is the device of FIG. 5 fully assembled.

Turning now to FIGS. 4, 5 and 6, a link 300 constructed in accordance with the concepts of the invention is shown. A high voltage cable is joined to a "T" shaped connector 50 by means of crimp connector 66 whose threaded aperture 68 receives the threaded end 36 of plug 215 which is further threaded into insulating bushing 302 fastened to apparatus wall 22 and received in arm 56 of "T" shaped connector 50. The contact portion 218 of plug 215 extends into the receptacle 304 of arm 54 of connector 50.

Apparatus bushing 20 is fixed to apparatus wall 22 and receives apparatus bushing extender 26 which is fixed to it by the threaded portion 292 of contact extender 290. Internally threaded portion 296 of contact extender 290 extends into receptacle 308 of bushing extender 26.

Link 300 is similar to link 152' of FIG. 3. A central body 152 of insulating elastomeric material 202 has molded to it at selected locations a layer of conductive elastomeric material 204. From central body portion 152, projects a frusto-conically shaped leg 158 which contains a central metal tube 206 through which tools may be inserted (not shown) to assemble and disassemble the link 300, as will be described below, and to test the high voltage cable and apparatus. Extending from the opposite face of central body 152 are a pair of frusto-conically shaped legs 154' and 156. Leg 156 also contains a metallic tube 208 joined to the tube 206 by a buss bar 210 housed in central body portion 152.

Placed in suitable recesses in the interior surface 217 of tube 208 are a pair of louvered contact rings 222 of the type fully disclosed in U.S. Pat. No. 4,186,985 issued Feb. 5, 1980, entitled Electrical Connector, by Frank M. Stepniak and Andrew A. Kominiak and assigned to the Assignee of the instant invention. When leg 156 is fully seated in receptacle 304 in arm 54, contact portion 218 of plug 215 will be positioned in the end of tube 208 and within the contact rings 222 which will make electrical contact between contact portion 218 and tube 208 as is shown in FIG. 6.

The bore through tube 206 is enlarged at its end, as at 306 for clearance and at 310 to provide a drive shoulder 264 engaged by the leading edge of head 256 of bolt 254 to pull leg 154' forward to seat in receptacle 308 of bushing extender 26 and at the same time leg 156 seats in receptacle 304 of arm 54, as shown in FIG. 6. An annular recess 312 behind the trailing surface of head 256 of bolt 254 receives an annular retaining ring 314 to effectively capture bolt 254 and limit its travel within the bore of tube 206. When bolt 254 is moved to the left of FIG. 5, the trailing surface of head 256 of bolt 254 bears against retaining ring 314 separating arm 154' from receptacle 308 of bushing extender 26 and leg 156 from receptacle 304 of arm 54 of "T" shaped connector 50.

In applying the link 300, it is grasped by a hot stick (not shown) and positioned so that leg 154' enters receptacle 308 of bushing extender 26 and leg 156 enters receptacle 304 of arm 54 of connector 50 as is shown in FIG. 5. A tool of the type shown in U.S. Pat. No. 4,202,591 issued May 13, 1980, and assigned to the Assignee of the instant invention, is inserted through arm 158, tube 206 and into socket 268 in the bolt 254. Link 300 may be pushed further to the right of FIG. 5 and the bolt 254 turned so as to enter the internally threaded portion 296 of contact extender 290. As bolt 254 is tightened and acts upon drive shoulder 264, leg 154' is seated more tightly in receptacle 308 of extender 26, leg 156 is seated more tightly in receptacle 304 of arm 54 and contact portion 218 of plug 215 enters more deeply into the end of tube 208 until all components are fully seated as shown in FIG. 6. Because bolt 254 is only advanced once leg 154' is seated, there is little chance of jamming or cross threading. Further, the pin- and-socket arrangement of contact portion 218 with rings 222 only engage as bolt 254 is tightened and do not affect bolt 254.

To remove the link 300, bolt 254 is turned in the loosening direction until the trailing surface of head 256 engages retaining ring 314 after which the continued turning of bolt 254 exerts a positive force upon ring 314 causing separation of leg 154' from receptacle 308 and leg 156 from receptacle 304 and the separation of contact portion 218 from rings 222.

In place of the pin-and-socket arrangement of FIG. 5, the pin-and-socket arrangement of FIG. 4 could be used. The end of tube 208 could be left with a smooth interior surface 212 and the contact portion 218 of plug 215 could be replaced by a segmented bulbous end 40 of a plug 34. A ring (not shown) could be placed at the mouth of tube 208 to prevent unwanted withdrawl of plug 34. The operation of this embodiment would be the same as described above with respect to FIGS. 5 and 6.

While there have been shown and described and pointed out the fundamental novel features of the invention as applied to the preferred embodiments, it will be understood that various omissions and substitutions and changes of the form and details of the devices illustrated and in their operation may be made by those skilled in the art without departing from the spirit of the invention.

The embodiments of the invention in which an exclusive property or privilege is claimed are defined as follows:

1. A high voltage hot stick-operable screw and pin-and-socket assembled connector system for selectively coupling together a source of high voltage and a high voltage cable comprising:

a support member;

an apparatus bushing mounted upon said support member and electrically coupled to a source of high voltage;

a high voltage cable coupled to a connector mounted upon said support member;

selectively applicable pin-and-socket screw-operated link member when applied in a first arrangement joining said apparatus bushing to said cable to apply high voltage thereto or, when not applied between said apparatus bushing and said cable, providing a visible separation between said bushing and said cable;

said pin-and-socket, screw-operated link member comprising a first and a second housing assembly, one of said first and second housing assemblies containing a socket to mate with a pin in said apparatus bushing or said cable connector and the other assembly containing a screw-operated member to mate with the other of said apparatus bushing or said cable connector;

a conductive metallic buss coupling said socket and said screw-operated member for electrically coupling same; and a third housing assembly providing access to said screw-operated member for selectively applying said link member in said first arrangement and for withdrawing said link member from such arrangement.

2. A link member as defined in claim 1, wherein said screw-operated member is retained in a bore within its associated first or second housing assembly to permit only limited travel of said screw-operated member within said bore.

3. A link member as defined in claim 2, wherein said screw-operated member has an enlarged head at its end adjacent said third housing assembly and said bore has a first annular shoulder upon which the leading surface of said enlarged head can bear to advance said first and second housing assemblies to apply said first arrangement.

4. A link assembly as defined in claim 3, further comprising an annular retaining ring in said bore upon the trailing surface of said enlarged head can bear to remove said first and second housing assemblies and remove said link member from said apparatus bushing and said cable.

5. A link assembly as defined in claim 3, wherein said enlarged head of said screw-operated member has a socket in its trailing surface adjacent said third housing assembly; said socket being engaged by a tool inserted through said third housing assembly to apply or remove said link member.

6. A link member as defined in claim 3, wherein said socket is caused to mate with said pin in said apparatus bushing of said cable connector at the same time said screw-operated member mates with the other of said apparatus bushing or said cable connector.

7. A link member as defined in claim 4, wherein said socket is caused to withdraw from said pin in said apparatus bushing or said cable connector at the same time as said screw-operated member is withdrawn from the other of said apparatus bushing or said cable connector.

8. A link member as defined in claim 1, wherein said pin is a cylindrical pin and said socket is a cylindrical bore with contact rings therein to engage the surface of said cylindrical pin when said socket is mated with said pin.

9. A link member as defined in claim 1, wherein said pin is a cylindrical hollow pin with its socket receiving end split and enlarged and said socket is a cylindrical bore, said split, enlarged pin ends contacting the interior surface of said socket bore.

* * * * *